US006647889B1

(12) United States Patent
Biserød

(10) Patent No.: US 6,647,889 B1
(45) Date of Patent: Nov. 18, 2003

(54) PROPELLING DEVICE FOR A PROJECTILE IN A MISSILE

(75) Inventor: Hans B. Biserød, Raufoss (NO)

(73) Assignee: Nammo Raufoss AS, Raufoss (NO)

( * ) Notice: Subject to any disclaimer, the term of this patent is extended or adjusted under 35 U.S.C. 154(b) by 0 days.

(21) Appl. No.: 09/980,944

(22) PCT Filed: Jun. 22, 2000

(86) PCT No.: PCT/NO00/00189

§ 371 (c)(1),
(2), (4) Date: Apr. 16, 2002

(87) PCT Pub. No.: WO00/75599

PCT Pub. Date: Dec. 14, 2000

(30) Foreign Application Priority Data

Jun. 4, 1999 (NO) ..... 19992739
Oct. 21, 1999 (NO) ..... 19995142

(51) Int. Cl.[7] ..... F42B 12/62
(52) U.S. Cl. ..... 102/489; 102/518
(58) Field of Search ..... 102/489, 517, 102/518, 377

(56) References Cited

U.S. PATENT DOCUMENTS 3,377,952 A * 4/1968 Crockett ..... 102/377
3,754,507 A 8/1973 Dillinger et al.
3,771,455 A * 11/1973 Haas ..... 102/377
4,126,078 A * 11/1978 Ashley ..... 89/7
4,448,106 A * 5/1984 Knapp ..... 89/1.11
4,448,129 A * 5/1984 Gabriels ..... 102/487
4,573,412 A 3/1986 Lovelace et al.
4,597,333 A * 7/1986 Bocker et al. ..... 102/518
4,624,187 A * 11/1986 Bocker et al. ..... 102/520
4,628,821 A * 12/1986 Madderra et al. ..... 102/517
4,648,324 A * 3/1987 McDermott ..... 102/518
4,770,101 A * 9/1988 Robertson et al. ..... 102/489
4,964,339 A 10/1990 Bastian et al.
5,109,774 A * 5/1992 Deffayet ..... 102/382
5,111,746 A * 5/1992 Pentel et al. ..... 102/308
5,189,248 A 2/1993 Deffayet et al.
5,347,907 A * 9/1994 Strandli et al. ..... 86/20.14
5,656,792 A * 8/1997 Rentzsch et al. ..... 102/489
6,276,277 B1 * 8/2001 Schmacker ..... 102/384
6,298,763 B1 * 10/2001 Greenfield et al. ..... 89/1.13
6,494,140 B1 * 12/2002 Webster ..... 102/374

FOREIGN PATENT DOCUMENTS

DE 2234 302 2/1973
EP 0151676 A2 B1 6/1990

* cited by examiner

*Primary Examiner*—Michael J. Carone
*Assistant Examiner*—Troy Chambers
(74) *Attorney, Agent, or Firm*—Knobbe, Martens, Olson & Bear, LLP

(57) ABSTRACT

A propelling device for a projectile that is lying in a standby position within a rocket motor in a missile. The projectile is translated with respect to the rocket motor by means of a pyrotechnic charge before the rocket motor is ignited. The projectile is lying within a translation tube centrally located in the rocket motor. The projectile comprises a power piston in the rear end thereof. The power piston encloses a pyrotechnic power charge and a pyrotechnic squib. The translation tube is sealable closed behind the power piston and forms a closed expansion chamber for the pyrotechnic charges which, by ignition, generate gas pressure that activates the power piston and thus propels the projectile forward within the translation tube.

20 Claims, 4 Drawing Sheets

PROPELLING DEVICE FOR A PROJECTILE IN A MISSILE

RELATED APPLICATIONS

Figure 1:
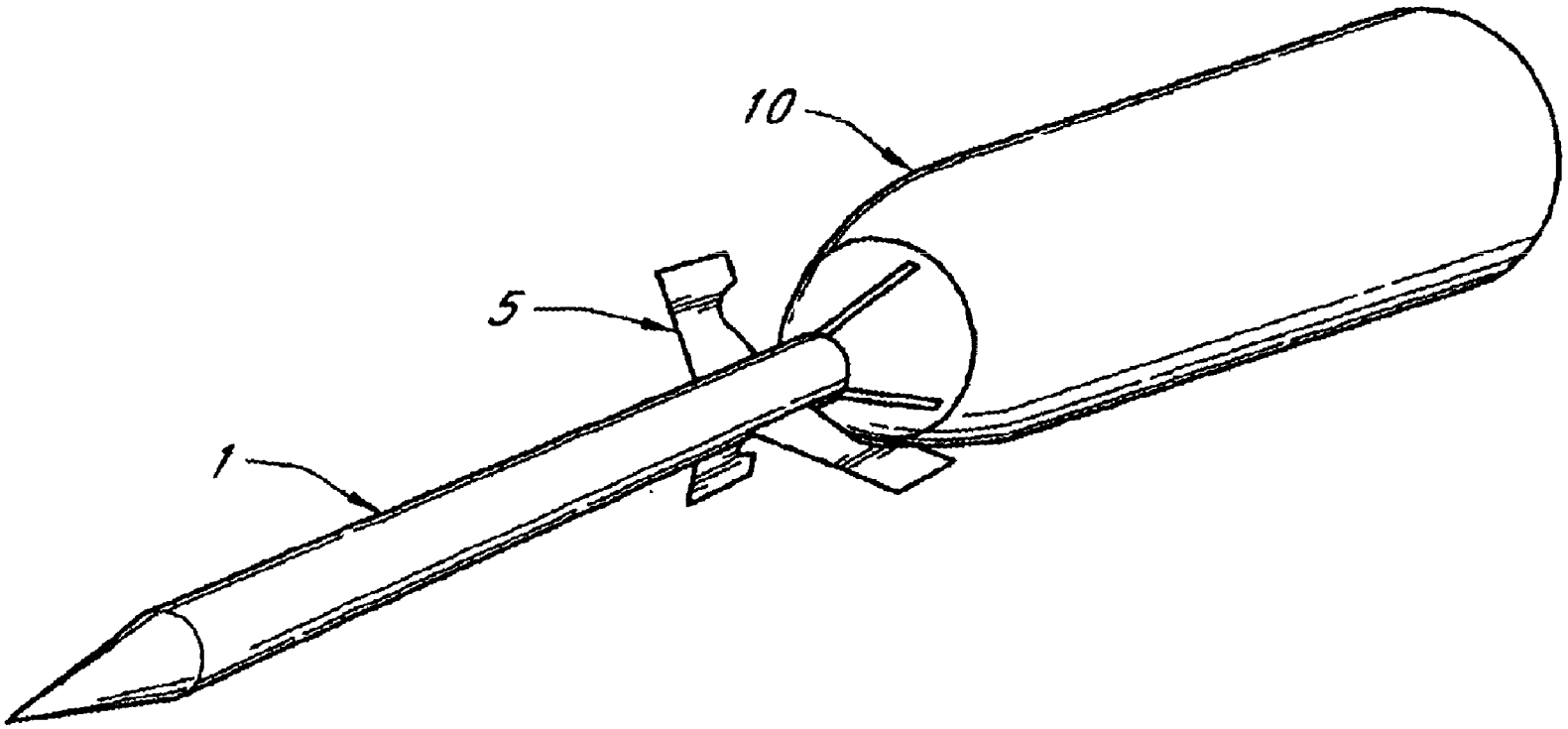

This application claims the benefit of the Norwegian applications 1999 2739 filed Jun. 4, 1999 and 1999 5142 filed Oct. 21, 1999 and the international application PCT/NO00/00189 filed Jun. 2, 2000. This application is related to applications "RELEASE MECHANISM IN A MISSILE" serial number 10/009,281 "TRANSLATION AND LOCKING MECHANISM IN A MISSILE" serial number 10/009,283, and "RETARDING AND LOCK APPARATUS AND METHOD FOR RETARDATION AND INTERLOCKING OF ELEMENTS" serial number 09/980,948 all filed concurrently herewith.

BACKGROUND OF THE INVENTION

1. Field of Invention

The present invention relates to a propelling device for a projectile that is lying in a standby position within a rocket motor in a missile, where the projectile is translated in respect of the rocket motor by means of a pyrotechnic charge before the rocket motor is initiated.

2. Description of the Related Art

The propelling device according to the invention is developed for use in missiles, and in particular, but not exclusively, in rocket accelerated penetrators. Rocket accelerated penetrators are often kept in their storing and standby state with the main parts thereof not assembled. This means that the part having control fins, the fin cone, and the rocket motor proper is assembled to the penetrator at the moment before the missile is launched from the launcher. The penetrator, which is in form of an arrow like body having substantial mass, is lying in standby position in a translation tube within the rocket motor and with the pointed end thereof supported in the control fin part. How the assembly operation happens is described in detail in the priority founding Norwegian patent application no. 19992739.

During launching preparations the penetrator is translated through the translation tube and the control fin part, and the rear end of the penetrator is interlocked to the control fin part immediately before the rocket motor is ignited. It is common practise that the rocket motor is separated from the penetrator during the flight thereof as soon as the rocket motor is burned out and has lost its propelling force. It is the device for the forward propelling of the penetrator, and more generally the projectile, within the rocket motor until the rear end of the projectile locks to the rocket motor, the present application deals with.

SUMMARY OF THE INVENTION

According to the invention, a propelling device of the introductorily described kind is provided, which is distinguished in that the projectile is lying within a translation tube located centrally in the rocket motor, that the projectile comprises a power piston in the rear end thereof, that the power piston encloses a pyrotechnic igniter charge and a pyrotechnic squib and that the translation tube is sealingly closed behind the power piston and forms a closed expansion chamber for the pyrotechnic charges, which by ignition generates gas pressure that activates the power piston and thus the projectile.

In one embodiment the translation tube is sealingly closed behind the power piston by means of an end closure, which end closure is movable axially forward within the translation tube after the ignition of the pyrotechnic charges and translation of the power piston and the penetrator. At which moment of time the end closure moves forwards is dependent of the difference between the pressure in the chambre in the translation tube and the pressure that is generated within the rocket motor when initiated. The motional freedom of the end closure provides a possibility to balance this pressure differential. Thus fragmentation, collapse of or deformation of the translation tube during launching is avoided. At any costs, it is to be avoided that fragments from the inner parts of the rocket are getting into the nozzels of the rocket motor.

As a first alternative, the end closure is abutting an internal shoulder in the rear end of the translation tube.

As a second alternative, the end closure is abutting a perforated plate integrated to the rear end of the translation tube.

Preferably, a sealing means, such like an O-ring, can be provided between the end closure and the translation tube.

In one embodiment, the rear end of the projectile can be an integrated power piston that follows the projectile during the flight thereof In a second embodiment, the power piston can be releasable from the projectile together with the rocket motor.

The propelling charge proper can be any suitable pyrotechnic charge, such like leadazide, BKNO3 or gunpowder and be in form of moulded pellets, granules or powder charge (pyrogenic igniter).

It is to be understood that the propelling device has completed its mission before the rocket motor is initiated and launched.

BRIEF DESCRIPTION OF THE RELATED ART

Figure 2:
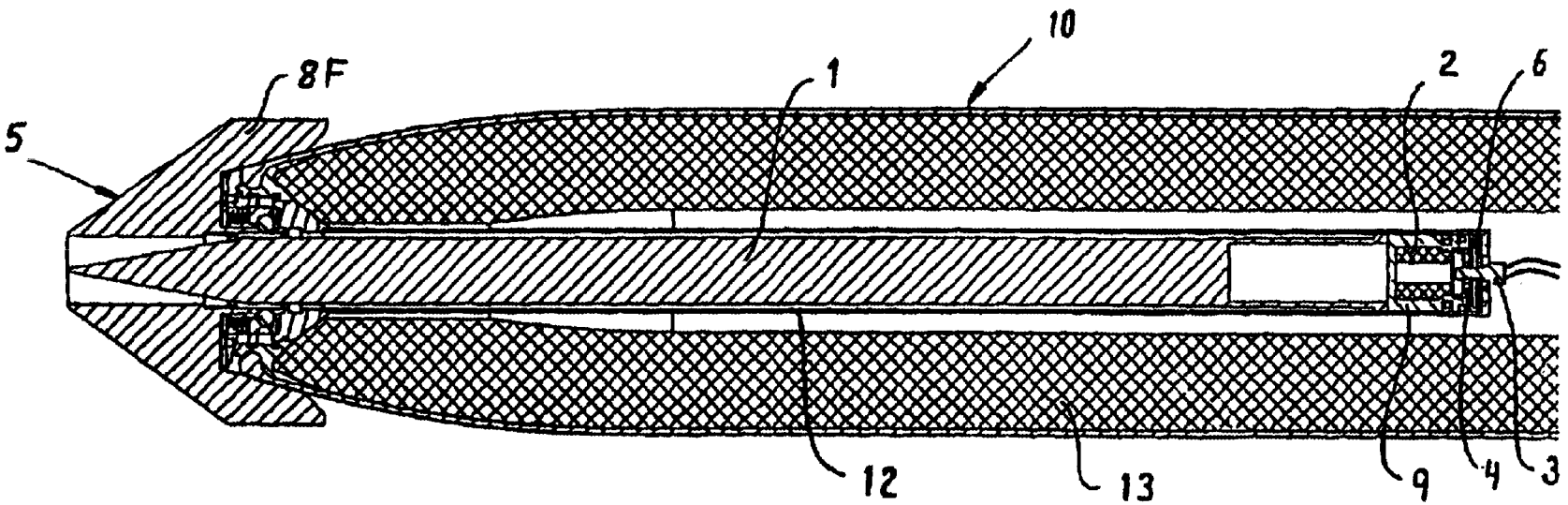
Figure 3:
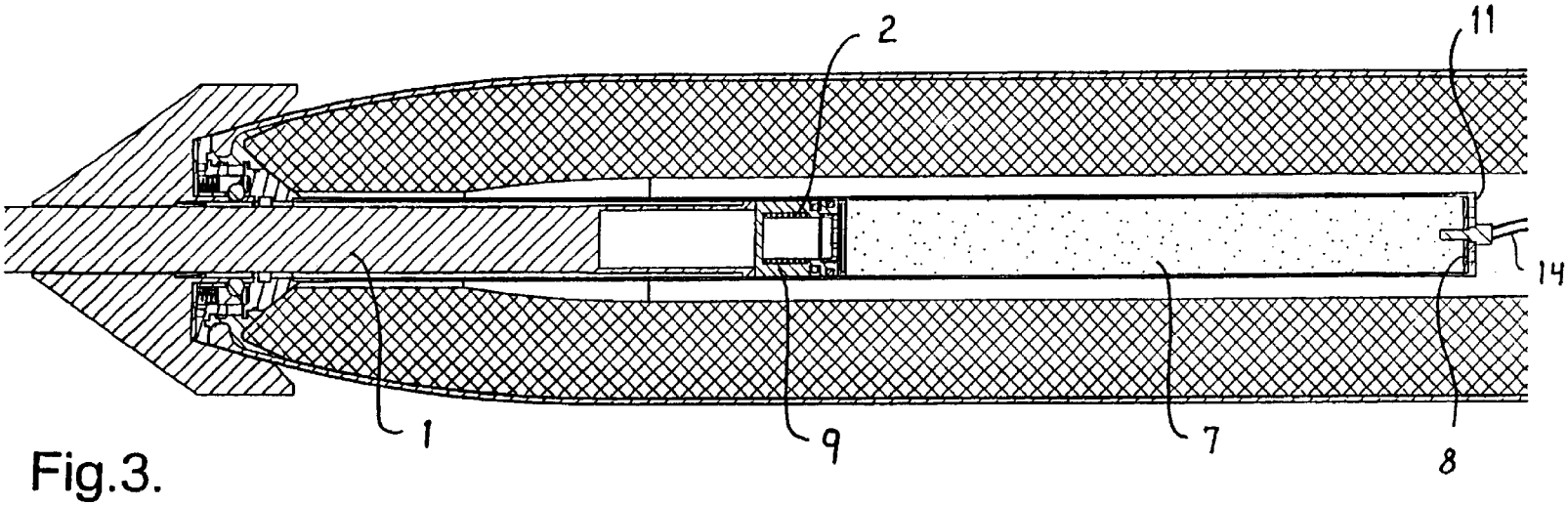
Figure 4:
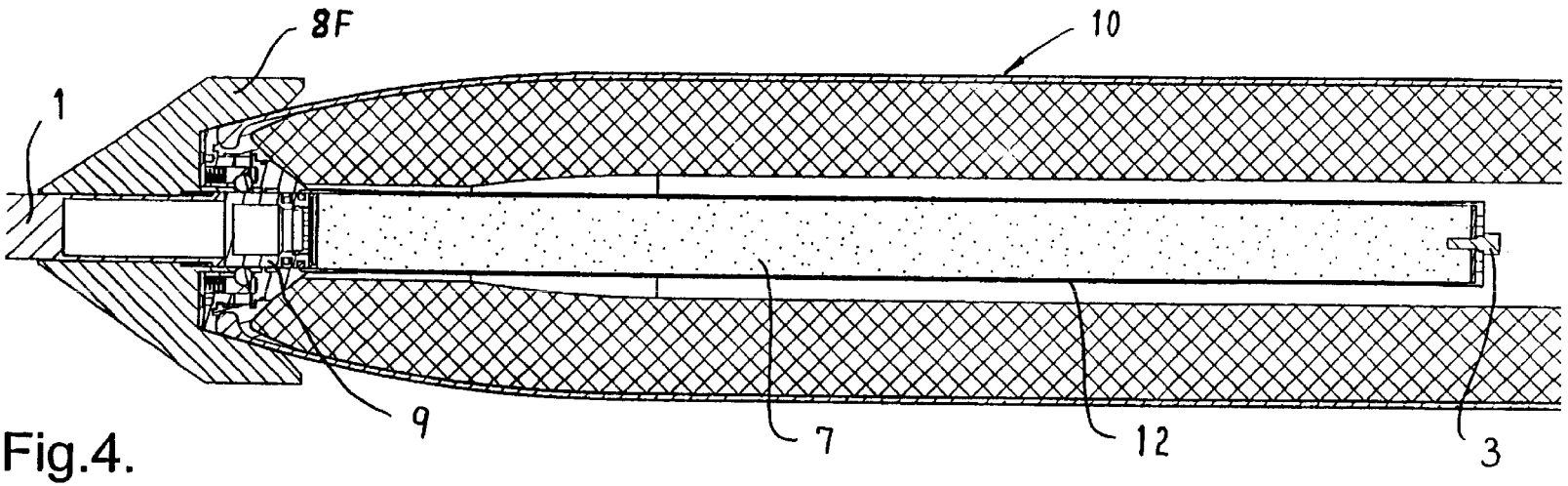
Figure 5:
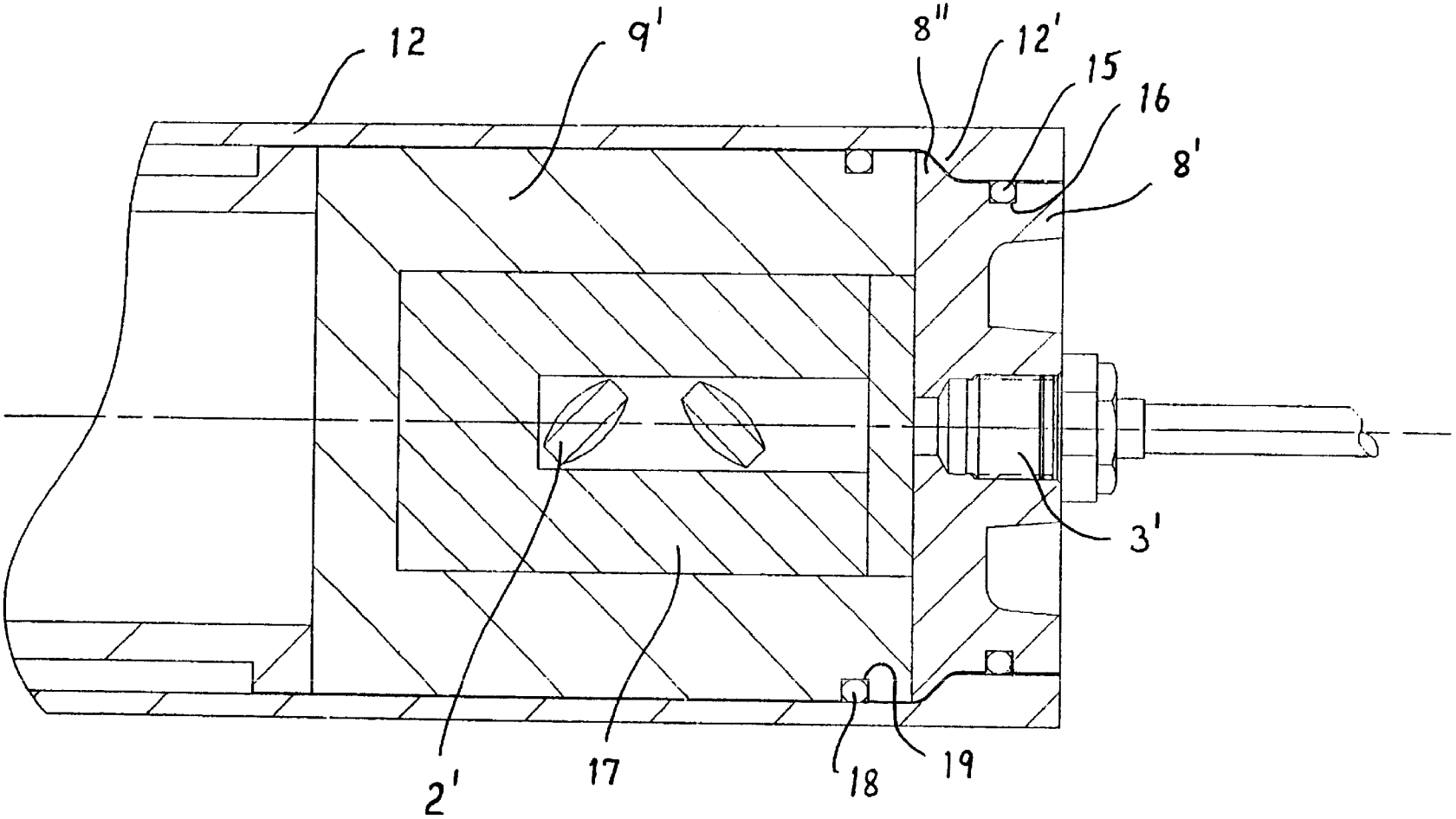

Other and further objects, features and advantages will appear from the following description of one for the time being preferred embodiment of the invention, which is given for the purpose of description, without thereby being limiting, and given in context with the appended drawings where:

FIG. 1 shows schematically a rocket accelerated penetrator,

FIG. 2 shows in longitudinal section a penetrator in the standby position thereof within the forward end of a rocket motor, FIG. 3 shows in longitudinal section a partly translated penetrator within a rocket motor, FIG. 4 shows in longidutinal section the rear part of the penetrator when the penetrator is completely translated within the translation tube, and FIG. 5 shows one embodiment of the rear end of the translation tube and the power piston.

DESCRIPTION OF THE PREFERRED EMBODIMENTS

The description is related to a missile in form of a penetrator and a rocket motor, but the invention is not limited to a penetrator only. Any projectile, with or without warhead, can together with a rocket motor use the propelling device according to the invention.

We firstly refer to FIG. 1 that illustrates a missile in flight. The missile comprises a penetrator 1, a control fin part 5 and a rocket motor 10 as main components. The penetrator 1 is an arrow like body having substantial mass, preferably of tungsten or depleted uranium. A penetrator is a projectile omit warhead and do achieve its destructive effect owing to the kinetic energy thereof.

FIG. 2 shows the penetrator 1 in the way it is lying in standby position within a translation tube 12 centrally located in the rocket motor 10 during storage until launching, or ready for launching from a launching pipe or launcher (not shown).

The penetrator 1 is held axially in place within the rocket motor 10 by a closure means (not shown) having a cap that can be opened or burst away.

The reference number 8F refers to one of four control fins that are located circumferentially about a centre and having equal pitch or angular distance from each other. The number of fins 8F can vary according to desire. The rocket motor 10 is, as mentioned, releasable fixed to the control fin part 5. The rocket motor 10 is released and does separate from the control fin part 5 during the flight of the missile when a propellant charge 13 within the rocket motor 10 is burned out and retardation occur.

The release mechanism between the control fin part and the rocket motor is described in closer detail in copending U.S. patent application Ser. No. 10/009,281. The mechanism for translation of the projectile and subsequent locking to the rocket motor is described in closer detail in copending U.S. patent application no. 10/009,283.

FIG. 3 shows the rear end of the penetrator 1 when the penetrator is partly translated through the translation tube 12 in the rocket motor 10 and the control fin part 5. The rear end of the penetrator 1 interlocks to the control fin part 5 after this translation. How this happens is, as mentioned, described in closer detail in U.S. patent application Ser. No. 09/980,948.

The penetrator 1 is, as mentioned, lying within a translation tube 12 within the rocket motor 10 and is translated, or propelled, by means of a pyrotechnic power charge 2, or a pyrogenic igniter, that is received within a power piston 9. The pyrotechnic power charge 2 is ignited by a pyrogenic squib 3 that initiates the entire translating and launching operation. The pyrogenic squib 3 is lying rearmost in the translation tube 12 and ignites at the power charge 2 in the power piston 9. The pyrotechnic charge in the squib 3 is ignited by means of electric power that is supplied via wires 14 to a thin glow filament that is embedded in the pyrotechnic charge in the squib 3.

As one alternative, a laser igniter can be used. Here the laser light is transferred through an optical leader of glass and the light is amplified or consentrated through a prism just ahead of a transfer charge so that this is extremely rapidly heated and ignited. The pyrotechnic charge, or igniter, can be in form of compressed or moulded powder, alternatively moulded pellets or granules and constitute leadazide labelled BKNO3.

As mentioned, the power piston 9 envelopes a pyrotechnic power charge 2 that by ignition generates gas pressure that is able to expand rearwards through one or more apertures 4 in the rear wall 6 of the power piston 9. The pyrogenic squib 3 having the pyrotechnic charge, is left behind in the rear end of the translation tube 12. The translation tube 12 is initially sealingly closed behind the power piston 9 and forms a closed expansion chamber 7 for the pyrotechnic charges that by ignition generate gas pressure and activates the power piston 9 and thus propells the projectile 1 forward within the translation tube 12. In FIG. 3 is the power charge 2 shown partly burnt out.

In one embodiment is the translation tube 12 sealingly closed behind the power piston 9 by means of an end closure 8. The end closure 8 can, however, move axially forward in the translation tube 12 after ignition of the pyrotechnic charges and translation of the power piston 9. At which moment of time the end closure 8 moves forward is dependent of the pressure differential of the expansion chamber 7 within the translation tube 12 and the pressure that is generated by the propellant charge 13 in the rocket motor 10 when initiated. The motional freedom of the end closure 8 provides a means to balance this pressure differential. Thus fragmentation, collapse of or deformation of the translation tube 12 during launching is avoided.

The end closure 8 can in one variant (not shown) abut against an internal shoulder in the rear end of the translation tube 12. In the shown alternative the end closure 8 abuts a perforated plate 11 that is integrated to the rear end of the translation tube 12. Further is a sealing means, such like an O-ring, arranged between the end closure 8 and the translation tube 12.

FIG. 4 shows when the penetrator is completely translated in the translation tube 12 and the power piston 9 has been locked to the forward end of the rocket motor 10. Simultaneously, the rear end of the penetrator 1 has been locked to the control fin part 5 as described in U.S. application Ser. No. 09/980,948.

FIG. 5 shows another embodiment of the rear end of the translation tube 12. The rear end has an internal shoulder 12'. The end closure 8' has a corresponding complementary shoulder 8", which initially abuts the shoulder 12'. An O-ring 15 is arranged in an external groove 16 on the end closure 8' and seals against an internal circumferential surface on the shoulder 12'. A squib 3' is mounted to the end closure 8'. The power piston 9' retains a power charge 2', in form of pellets, or more generally a pyrogen igniter charge, that are enclosed by a foam substance 17. Another O-ring 18 is provided in a groove 19 in the external surface of the piston 9' and seals against the internal surface of the translation tube 12.

As in the one embodiment above, the translation tube 12 is sealingly closed behind the power piston 9' by the end closure 8'. The end closure 8' can move axially forwards in the translation tube 12 after ignition of the pyrotechnic charges and translation of the power piston 9'. As with the other embodiment will the moment of time that the end closure 8' moves forward be dependent of the difference between the gas pressure within the expansion chamber 7 in the translation tube 12 and the pressure that generates by the propellant charge 13 within the rocket motor 10 when initiated. The motional freedom of the end closure 8' balances this pressure differential. As b&fore, this will avoid fragmentation, collapse of or deformation of the translation tube 12 during translation and launching.

As a non illustrated alternative, the rear end of the projektile 1 can be an integrated power piston that follows the projectile 1 during the flight thereof Then the power piston 9, in stead of locking to the front end of the rocket motor 10, will lock to the rear and central extension of the control fin part 5.

The translation tube 12 can be made of any suitable material, such like titanium, steel, aluminum, composite, i.e. carbon fibre in epoxy, and lined with aluminum, steel or titanium. The power piston 9 can also be made of any suitable material, such as titanium, alum inurn, steel or ceramics. The translation tube 12 may preferably be coated with a lubricating agent, such like graphite or molycote.

What is claimed is:

1. A propelling device for a projectile that is lying in a standby position within a rocket motor in a missile, where the projectile is translated with respect to the rocket motor, the propelling device comprising:

a pyrotechnic charge, or pyrogen igniter;

a pyrogenic squib in contact with the pyrotechnic charge or pyrogen ignitor;

a translation tube centrally located in the rocket motor;

a projectile arranged within the translation tube;

a power piston arranged in the translation tube and at the rear end of the projectile wherein the power piston encloses the pyrotechnic charge or pyrogenic ignitor and the pyrogenic squib and wherein the translation tube is sealably closed behind the power piston and forms a closed expansion chamber for the pyrotechnic charge or pyrogenic ignitor, which by ignition generates gas pressure that propels the power piston and thus the projectile.

2. The propelling device of claim 1, further comprising, an end closure arranged such that the translation tube is sealably closed behind the power piston by means of the end closure which is movable axially forward within the translation tube after the ignition of the pyrotechnic charge or pyrogenic ignitor and translation of the power piston.

3. The propelling device of claim 2, wherein the translation tube defines an internal shoulder adjacent the rear end thereof and the end closure abuts the internal shoulder in the rear end of the translation tube.

4. The propelling device of claim 2, further comprising a perforated plate wherein the end closure abuts the perforated plate and wherein the perforated plate is integrated to the rear end of the translation tube.

5. The propelling device of claim 2, further comprising a seal, arranged between the end closure and the translation tube.

6. The propelling device of claim 2, further comprising a seal, arranged between the power piston and the translation tube.

7. The propelling device of claim 1, wherein the power piston is an integrated part of the projectile.

8. The propelling device of claim 1, wherein the power piston is releasable together with the rocket motor from the projectile.

9. The propelling device of claim 1, wherein the pyrotechnic charge, or pyrogen igniter comprises molded pellets, compressed or molded powder or granules, or mixed, cast and cured composite propellant.

10. The propelling device of claim 1, wherein the projectile is a penetrator.

11. The propelling device of claim 5, wherein the seal comprises an O-ring.

12. The propelling device of claim 6, wherein the seal comprises an O-ring.

13. A missile comprising:

a rocket motor wherein the rocket motor propels the missile;

a translation tube arranged within the rocket motor;

a projectile positioned within the translation tube, wherein the projectile is adapted to separate from the rocket motor while the missile is in flight; and a power piston positioned within the translation tube wherein the power piston comprises ignitable components such that the power piston induces the projectile to move down the translation tube before the missile is in flight.

14. The missile of claim 13, wherein the power piston includes a pyrotechnic charge that is ignited to generate gas pressure that activates the power piston.

15. The missile of claim 14, further comprising a pyrogenic squib arranged to ignite the pyrotechnic charge.

16. The missile of claim 15, further comprising a laser ignitor arranged to ignite the pyrotechnic charge.

17. The missile of claim 13, wherein the translation tube is positioned axially within the rocket motor casing.

18. The missile of claim 17, further comprising an end closure arranged to seal the end of the translation tube behind the power piston and wherein the end closure axially moves within the translation tube following igniting of the power piston.

19. The missile of claim 18, wherein the translation tube includes an internal shoulder and wherein the end closure abuts the internal shoulder prior to ignition of the power piston.

20. The missile of claim 13, wherein the translation tube is positioned within the rocket motor.

* * * * *